US007140306B2

(12) United States Patent
Chen

(10) Patent No.: US 7,140,306 B2
(45) Date of Patent: Nov. 28, 2006

(54) AUXILIARY TABLE PLATE DEVICE WITH ELEVATION ADJUSTING DEVICE

(75) Inventor: Chao Ken Chen, Chung-Hua Hsien (TW)

(73) Assignee: Greg Moore, Temple, TX (US)

( * ) Notice: Subject to any disclaimer, the term of this patent is extended or adjusted under 35 U.S.C. 154(b) by 339 days.

(21) Appl. No.: 10/782,347

(22) Filed: Feb. 20, 2004

(65) Prior Publication Data

US 2005/0263046 A1 Dec. 1, 2005

(30) Foreign Application Priority Data

Sep. 30, 2003 (CN) ..... 092217618

(51) Int. Cl.
*A47B 1/00* (2006.01)

(52) U.S. Cl. ..... 108/138; 248/284.1

(58) Field of Classification Search ..... 248/281.11, 248/284.1, 286.1, 291.1, 292.13; 312/223.3, 312/208.1; 108/6, 8, 50.01, 50.02, 92, 93, 108/94, 95, 96, 138, 145, 146, 147
See application file for complete search history.

(56) References Cited

U.S. PATENT DOCUMENTS

| | | | | |
|---|---|---|---|---|
| 4,383,486 | A * | 5/1983 | Reineman et al. | 108/2 |
| 4,632,249 | A * | 12/1986 | Blot | 206/431 |
| 5,398,622 | A * | 3/1995 | Lubinskas et al. | 108/145 |
| 5,791,263 | A | 8/1998 | Watt et al. | |
| 5,927,662 | A * | 7/1999 | West et al. | 248/118 |
| 5,992,810 | A * | 11/1999 | Crinion et al. | 248/284.1 |
| 6,038,986 | A * | 3/2000 | Ransil et al. | 108/145 |
| 6,336,618 | B1 * | 1/2002 | Barber | 248/284.1 |
| 7,013,813 | B1 * | 3/2006 | Lima et al. | 108/10 |

* cited by examiner

*Primary Examiner*—Janet M. Wilkens

(57) ABSTRACT

An auxiliary table plate device with an elevation adjusting device includes two linkages at two sides; one end of each linkage being connected to an auxiliary table plate; and another end of each linkage being connected to a twisting element; the twisting element rotating as the twisting element is driven by a telescopic pressure pump so as to drive the linkages; thus the auxiliary table plate connected to the linkages rotating to change the elevation of the auxiliary table plate; when the pump stops, the auxiliary table plate being fixed.

17 Claims, 4 Drawing Sheets

AUXILIARY TABLE PLATE DEVICE WITH ELEVATION ADJUSTING DEVICE

FIELD OF THE INVENTION

The present invention relates to table devices, and particular to an auxiliary table plate device with an elevation adjusting device, wherein the auxiliary table plate is movable freely by rotation thereof. Thereby, the user can adjust the position of the auxiliary table plate to a desired position.

BACKGROUND OF THE INVENTION

Since more and more devices are necessary to be equipped on a table, such a computer and peripherals of the computer. Thereby, the area of a table is insufficient. An auxiliary table plate is equipped to the table.

Conventionally, an auxiliary table plate is telescopically and transversally connected to a main table plate. For example, a keyboard is placed on the auxiliary table plate. In use, the auxiliary table plate is pulled out from the main table plate to be out of the main table plate.

In general, the elevation of the main table plate is adjusted by using an air pressure rod. When a user seats for a long time, the user will feel tired. Thereby, sometimes, the user must stand up to change pose and then works continuously. However, the elevation of the height of the main table plate is finite so as not to match the requirement of the user. Furthermore, the heights of people are different. The auxiliary table plate confined in the main table plate cannot match to the requirement of the user. The user must make himself (or herself) to suit the design of the auxiliary table plate.

SUMMARY OF THE INVENTION

Accordingly, the primary object of the present invention is to provide an auxiliary table plate device with an elevation adjusting device, wherein the auxiliary table plate is movable freely by rotation thereof. Thereby, the user can adjust the position of the auxiliary table plate to a desired position.

To achieve above objects, the present invention provides an auxiliary table plate device with an elevation adjusting device includes two linkages at two sides; one end of each linkage being connected to an auxiliary table plate; and another end of each linkage being connected to a twisting element; the twisting element rotating as the twisting element is driven by a telescopic pressure pump so as to drive the linkages; thus the auxiliary table plate connected to the linkages rotating to change the elevation of the auxiliary table plate; when the pump stops, the auxiliary table plate being fixed.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
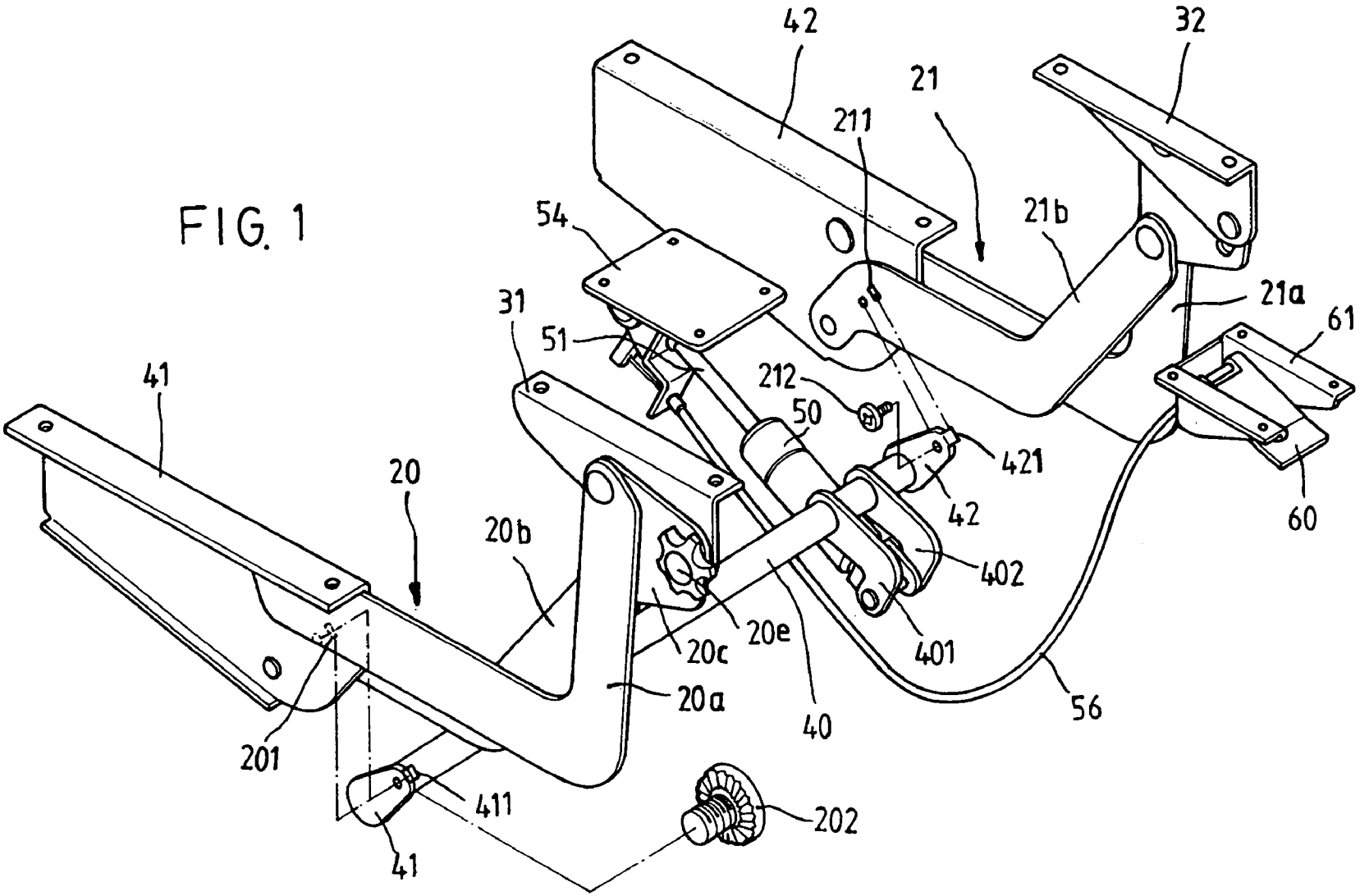
FIG. 1 shows the structure of the elevation adjusting device of the present invention.

Referring to FIG. 1, the auxiliary table plate device with an elevation adjusting device of the present invention for adjusting the elevation of an auxiliary table plate or likewise objects.

Figure 3:
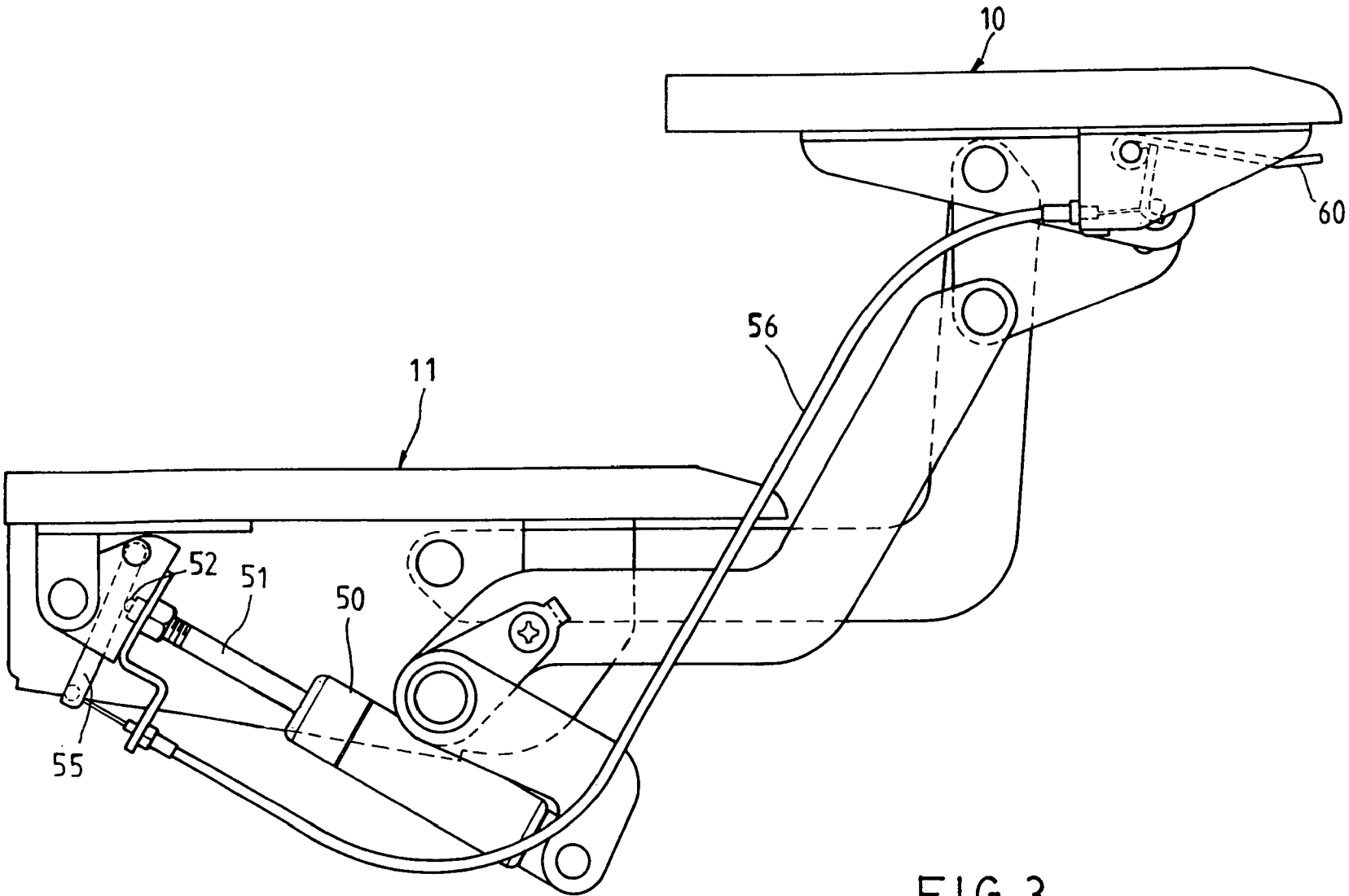
FIG. 3 shows a further operation of the elevation adjusting device of the present invention.

With reference to FIG. 3, the elevation adjusting device of an auxiliary table plate includes two opposite linkages 20, 21. Each linkage 20, 21 has a respective high position linkage 20*a*, 21*a* and a low position linkage 20*b*, 21*b*. One end of each linkage 20, 21 has a first supporting frame 31, 32 for connecting to an auxiliary table plate 10 and another end of each linkage has a second supporting frame 41, 42 to be connected to a main table plate 11. The first and second supporting frames 31, 32, 41, 42 have L shapes. One side of the L shape serves to connect the respective one of main and auxiliary table plates.

Figure 4:
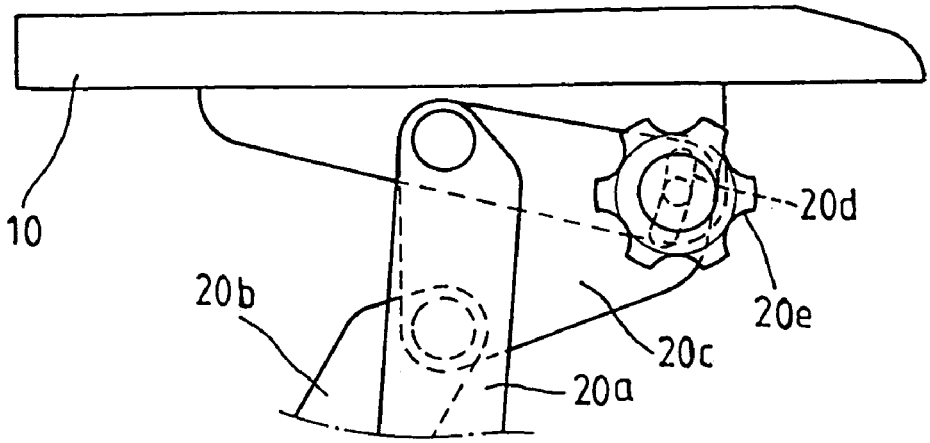
FIG. 4 shows the connection of the auxiliary table plate with the linkages of the present invention.
Figure 5:
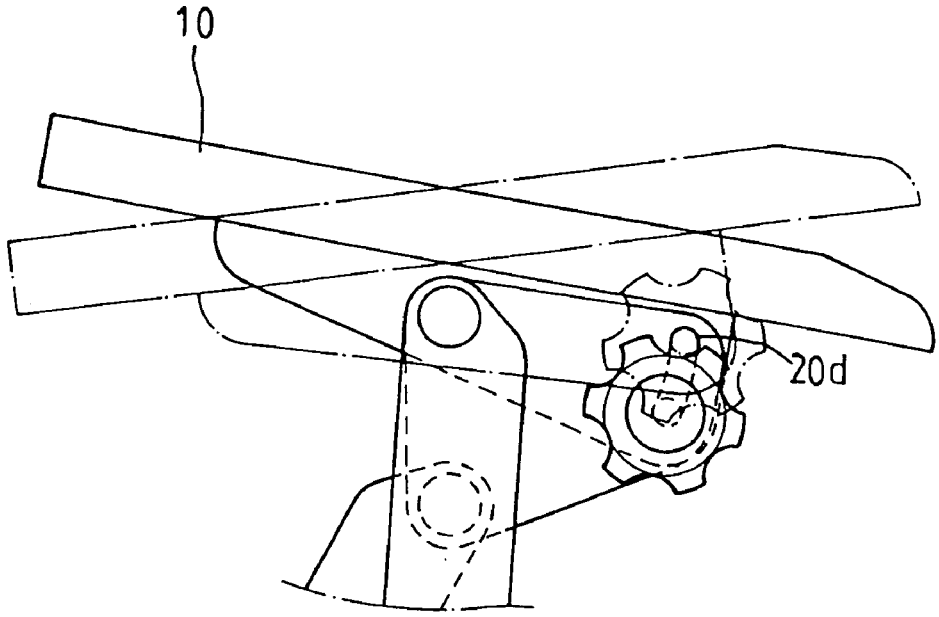
FIG. 5 shows the adjustment of the elevation angle of the auxiliary table plate according to the present invention.

With reference to FIGS. 4, and 5, an adapting plate 20*c* is connected between the high position linkage 20*a* and the respective low position linkage 20*b*. The adapting plate 20*c* is connected to the first supporting frame 31. A sliding hole 20*d* is formed in the adapting plate 20*c*. The sliding hole 20*d* has a round cambered shape so that the adapting plate 20*c* can be locked to the supporting frame 31 by using a stud 20*e* to pass through the sliding hole 20*d*. When the stud 20*e* is released, the supporting frame 31 is slidable for adjusting the elevation angle of the auxiliary table plate 10. When the orientation of the auxiliary table plate 10 has been adjusted, the stud 20*e* can be tightened.

The two linkages 20, 21 are connected by a twisting element 40 at one ends of the linkage 20, 21 connected to the main table plate 11. The twisting element 40 is a tube body. Two ends of the tube body are connected to the linkages 20, 21, respectively, by the second adapting plates 41, 42. Each of the second adapting plates 41, 42 is protruded with a respective guide plate 411, 421. The guide plate 411, 421 passes through a through hole 201, 211 in the linkage 20, 21. A sector screw 202, 212 serves to fix the second adapting plate 411, 421 to the linkage 20, 21.

Figure 2:
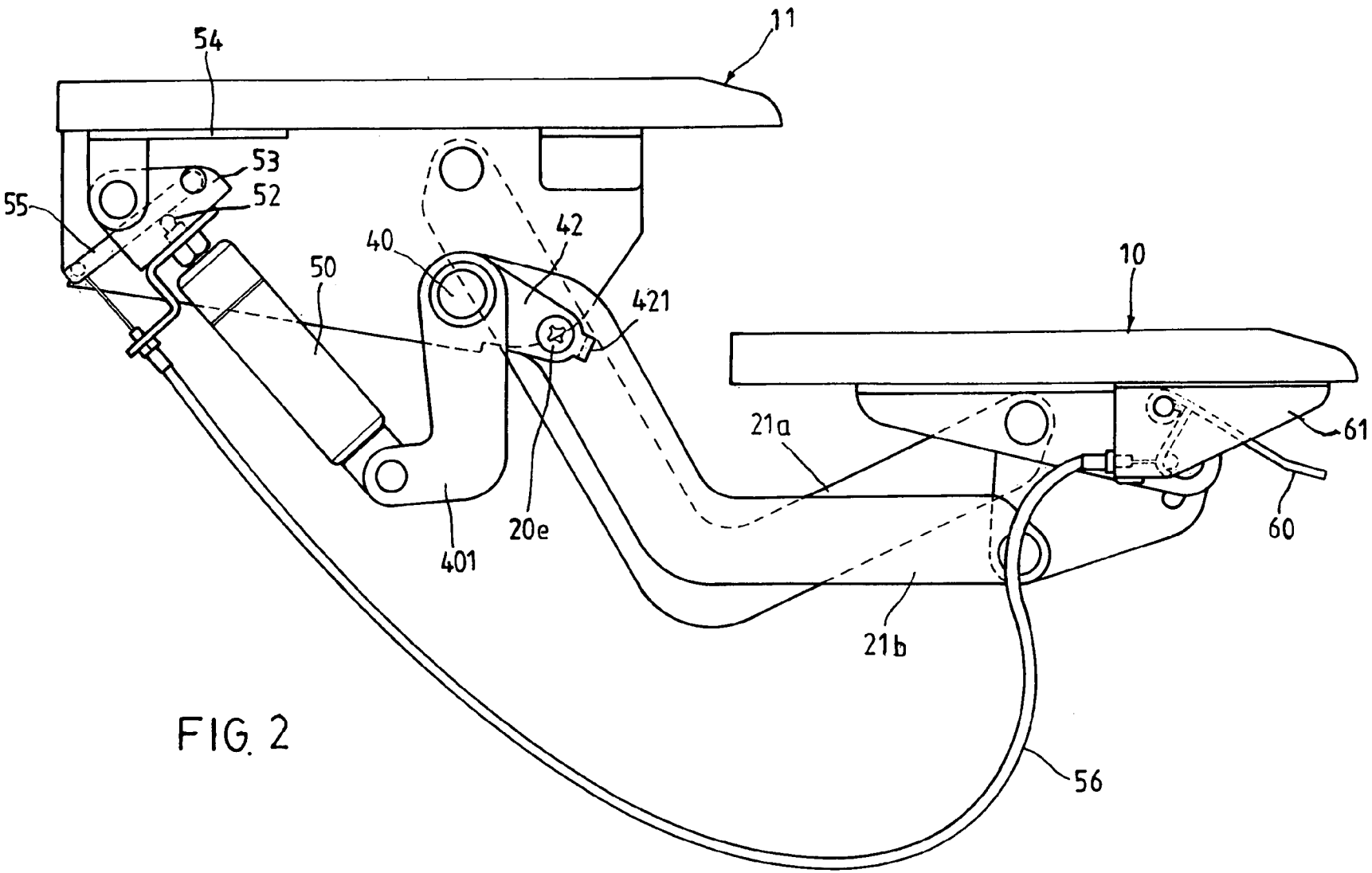
FIG. 2 shows the operation of the elevation adjusting device of the present invention.

The twisting element 40 is connected to the telescopic pressure pump 50 through two cranks 401, 402. When the pump 50 is pushed, the twisting element 40 will be driven to rotate. A telescopic rod 51 is installed within the pump. One end of the telescopic rod 51 far away from the pump 50 has a touch control panel 52. The same end of the telescopic rod 51 is connected to a third supporting frame 54 through a third adapting plate 43. Then the third adapting plate 43 is connected to the main table plate 11. One end of the third adapting plat 53 is installed with a press plate 55. Another end of the press plate 55 is connected to a connecting rope 56. The connecting rope 56 is further connected to the auxiliary table plate 10, as shown in FIG. 2. The press plate 55 slightly touches or does not touch the touch control point 52. When the connecting rope 56 is pulled, the press plate 55 applies a force to the touch control point 52 so as to compress the touch control point 52 to induce the pump 50 to push the telescopic rod 51 outwards. Since one end of the telescopic rod 51 is fixed by the third adapting plate 53. Thereby, the pump 50 is pushed away from the main table plate 11 (as an action to adjust a gas (or oil) pressure rod) so as to drive the cranks 401, 402 to rotate the twisting element 40.

Another end of the connecting rope 56 far away from the pump 50 is connected to a control plate 60. When the control plate 60 is moved, the connecting rope 56 will be pulled. The control plate 60 is further positioned to a fourth supporting frame 61. The fourth supporting frame 61 is further connected to a bottom of the auxiliary table plate 10.

With reference to FIG. 3, it is only necessary to move the control plate 60 (in the drawing, it is moved toward the auxiliary table plate 10). Then the press plate 55 will press the touch control point 52 so as to push the pump 50 to move away from the main table plate 11. Thereby, the cranks 401, 402 will rotate the twisting element 40 so as to drive the linkages 20, 21 to rotate counterclockwise to lift the auxiliary table plate 10 upwards. When the auxiliary table plate 10 reaches to a predetermined position. The control plate 60 will be released so that the pump will not move further and the twisting element 40 is suppressed from rotation. Then, the auxiliary table plate 10 is static and positioned by the supporting of the linkages 20, 21. Moreover, if it is desired to lower the auxiliary table plate 10, the control plate 60 is moved to actuate the pump 50. A slight force is applied to the auxiliary table plate 10 until it achieves to a predetermined position. By this operation, the elevation of the auxiliary table plate 10 is adjusted. Furthermore, by the action of the telescopic pressure pump, the power applied by the user is saved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An auxiliary table plate device with an elevation adjusting device including two linkages at two sides; one end of each linkage being connected to an auxiliary table plate; and another end of each linkage being connected to a twisting element; the twisting element rotating as the twisting element is driven by a telescopic pressure pump so as to drive the linkages so that the auxiliary table plate rotates and the elevation of the auxiliary table plate connected to the linkages is changed; when the pump stops, the auxiliary table plate is fixed.

2. The auxiliary table plate device with an elevation adjusting device as claimed in claim 1, wherein the twisting element is a tube body.

3. The auxiliary table plate device with an elevation adjusting device as claimed in claim 2, wherein two ends of the tube body are connected to the linkages, respectively, by respective adapting plates; each of the adapting plates is protruded with a respective guide plate; the guide plate passes through a through hole in the linkage.

4. The auxiliary table plate device with an elevation adjusting device as claimed in claim 1, wherein each linkage has a high position linkage and a low position linkage.

5. The auxiliary table plate device with an elevation adjusting device as claimed in claim 4, wherein one end of each linkage is connected to the auxiliary table plate through a supporting frame; and another end of the linkage is connected to a main table plate by another supporting frame.

6. The auxiliary table plate device with an elevation adjusting device as claimed in claim 5, wherein the supporting frame has an L shape.

7. The auxiliary table plate device with an elevation adjusting device as claimed in claim 4, wherein the linkage is connected to an adapting plate; the adapting plate is connected to a supporting frame; a sliding hole is formed in the adapting plate; the sliding hole has a round cambered shape so that the adapting plate is locked to the supporting frame by using a stud to pass through the sliding hole; when the stud is released; the supporting frame is slidable for adjusting an elevation angle of the auxiliary table plate; when the orientation of the auxiliary table plate has been adjusted, the stud is tightened.

8. The auxiliary table plate device with an elevation adjusting device as claimed in claim 4, wherein a telescopic rod is installed within the pump; one end of the telescopic rod far away from the pump has a touch control panel; the same end of the telescopic rod is connected to a supporting frame through an adapting plate; then the adapting plate is connected to a main table plate.

9. The auxiliary table plate device with an elevation adjusting device as claimed in claim 8, wherein one end of the adapting plate is installed to one end of a press plate and another end of the press plate is connected to a connecting rope; the connecting rope is connected to the auxiliary table plate.

10. The auxiliary table plate device with an elevation adjusting device as claimed in claim 9, wherein one end of the connecting rope far away from the pump is connected to a control plate; the control plate is further positioned to another supporting frame; the another supporting frame is further connected to a bottom of the auxiliary table plate.

11. The auxiliary table plate device with an elevation adjusting device as claimed in claim 1, wherein one end of each linkage is connected to the auxiliary table plate through a supporting frame; and another end of the linkage is connected to a main table plate by another supporting frame.

12. The auxiliary table plate device with an elevation adjusting device as claimed in claim 11, wherein the supporting frame has an L shape.

13. The auxiliary table plate device with an elevation adjusting device as claimed in claim 1, wherein the linkage is connected to an adapting plate; the adapting plate is connected to a supporting frame; a sliding hole is formed in the adapting plate; the sliding hole has a round cambered shape so that the adapting plate is locked to the supporting frame by using a stud to pass through the sliding hole; when the stud is released; the supporting frame is slidable for adjusting an elevation angle of the auxiliary table plate; when the orientation of the auxiliary table plate has been adjusted, the stud is tightened.

14. The auxiliary table plate device with an elevation adjusting device as claimed in claim 1, wherein the twisting element is connected to the telescopic pressure pump through two cranks.

15. The auxiliary table plate device with an elevation adjusting device as claimed in claim 1, wherein a telescopic rod is installed within the pump; one end of the telescopic rod far away from the pump has a touch control panel; the same end of the telescopic rod is connected to a supporting frame through an adapting plate; then the adapting plate is connected to a main table plate.

16. The auxiliary table plate device with an elevation adjusting device as claimed in claim 15, wherein one end of the adapting plate is installed to one end of a press plate and another end of the press plate is connected to a connecting rope; the connecting rope is connected to the auxiliary table plate.

17. The auxiliary table plate device with an elevation adjusting device as claimed in claim 16, wherein one end of the connecting rope far away from the pump is connected to a control plate; the control plate is further positioned to another supporting frame; the another supporting frame is further connected to a bottom of the auxiliary table plate.

* * * * *